United States Patent [19]

Da Silva

[11] Patent Number: 4,525,623

[45] Date of Patent: Jun. 25, 1985

[54] HAIR-DRIER WITH VALVES FOR CONTROLLING THE AIR FLOW

[75] Inventor: Artur F. Da Silva, Saô Paulo, Brazil

[73] Assignee: U.S. Philips Corporation, New York, N.Y.

[21] Appl. No.: 513,900

[22] Filed: Jul. 15, 1983

[30] Foreign Application Priority Data

Jul. 19, 1982 [BR] Brazil ..... 6200942

[51] Int. Cl.[3] ..... A45D 20/26; F24H 3/00; H05B 1/00

[52] U.S. Cl. ..... 219/373; 34/96; 137/601; 219/368; 219/370

[58] Field of Search ..... 219/366–371, 219/373; 239/569, 581; 137/601; 251/228; 34/96–101

[56] References Cited

U.S. PATENT DOCUMENTS

| | | | |
|---|---|---|---|
| 1,765,380 | 6/1930 | McGinnis | 34/99 |
| 2,782,527 | 2/1957 | Schweitzer et al. | 34/99 |
| 3,241,568 | 3/1966 | Mayo, Jr. | 137/601 |
| 3,384,112 | 5/1968 | Smith | 137/601 |
| 3,547,152 | 12/1970 | Hess | 137/601 |
| 3,877,677 | 4/1975 | Daghe et al. | 251/228 |
| 4,076,035 | 2/1978 | Frisch | 137/601 |
| 4,232,454 | 11/1980 | Springer | 219/368 |
| 4,366,368 | 12/1982 | Stephens | 34/97 |
| 4,377,181 | 3/1983 | Chan | 137/601 |
| 4,391,047 | 7/1983 | Janssens et al. | 219/373 |

FOREIGN PATENT DOCUMENTS

| | | | |
|---|---|---|---|
| 1066712 | 10/1959 | Fed. Rep. of Germany | 34/97 |
| 2630484 | 1/1978 | Fed. Rep. of Germany | 137/601 |

*Primary Examiner*—Roy N. Envall, Jr.
*Assistant Examiner*—Geoffrey S. Evans
*Attorney, Agent, or Firm*—Rolf E. Schneider

[57] ABSTRACT

A hair-drier including a tubular housing having an air outlet is provided with two valve members pivotally mounted in the housing for controlling the flow of air therethrough. An opening is formed in the wall of the housing; and a rotatable member extends through such opening for actuating the valve members, two curved slots being formed in the actuating member. A projection is provided on each valve member for respective engagement with the curved slots so that upon turning of the actuating member, the valve members are pivoted in opposite directions.

6 Claims, 2 Drawing Figures

HAIR-DRIER WITH VALVES FOR CONTROLLING THE AIR FLOW

Figure 1:
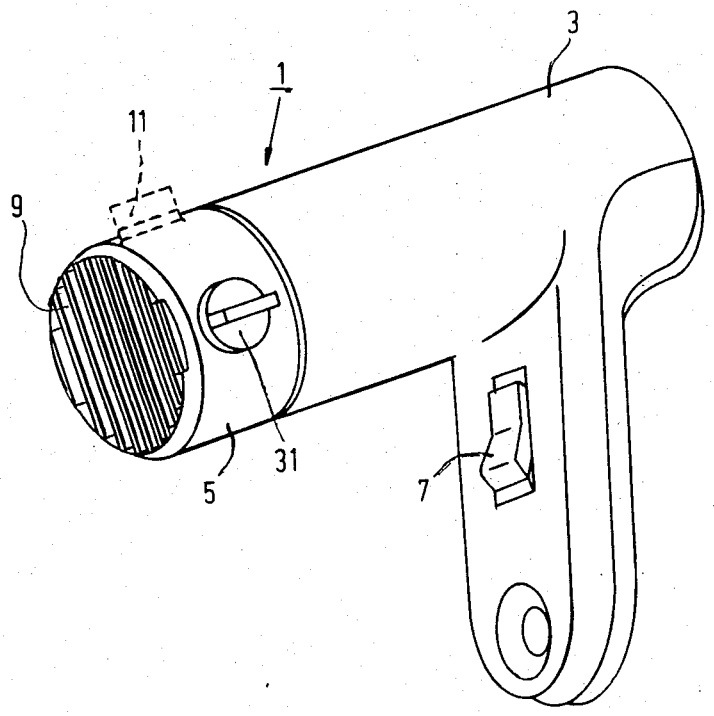

This invention relates to a hair-drier, which comprises a housing, which is provided with an air outlet, a heating element, a fan and two valves, which are pivotally mounted in the housing, for controlling the air flow, which valves can be actuated by means of a rotatable actuating member which extends through an opening in the wall of the housing.

Such a hair-drier is disclosed in U.S. Pat. No. 4,232,454. The known hair-drier has two diametrically arranged valves, which are situated in the space between the heating element and the air outlet. Both valves are formed with a slot, through which an actuating rod extends, the rod being provided with a right-hand screw-thread over a part of its length and with a left-hand screw-thread over another part of its length. Outside the housing of the hair-drier the rod is provided with a knob. By turning the knob the valves are pivoted towards or away from each other, to reduce or to increase the passage of air.

The known hair-drier has the disadvantage that mounting the valves and the actuating rod in the hair-drier housing is rather intricate. An additional disadvantage is that during operation the actuating rod is constantly exposed to the hot air, so that the knob becomes unnecessarily warm as a result of heat conduction.

It is the object of the present invention to improve the hair-drier of the type mentioned above so as to mitigate said drawbacks.

According to the invention the hair-drier of the invention is characterized in that the valves are each provided with a projection which co-operates with a curved slot formed in the actuating member.

Thus, the actuating member in the hair-drier in accordance with the invention has two slots, which each engage a projection. The slots are oriented so that during rotation of the actuating member the valves are pivoted towards or away from each other, depending on the direction of rotation, thereby reducing or increasing the air passage in the housing. When the speed of the fan remains the same a movement of the valves towards each other results in an increasing velocity of the outflowing air and a movement of the valves away from each other results in a decrease in this velocity. In this way a user can adjust the air-flow rate by turning the actuating member.

An advantage of the hair-drier in accordance with the invention is that a flow-rate control is obtained with an extremely simple and easy-to-assemble construction.

A preferred embodiment of the invention is characterized in that the actuating member comprises two parts which engage each other, of which a first part is disposed mainly outside the housing and of which a second part is disposed inside the housing, the slots being formed in said second part in the side which faces the valves.

The two-part actuating member has the advantage that it is secured to the housing wall by simply sliding the two parts into one another. A more permanent coupling between the two parts can be obtained through frictional forces or by means of a snap connection.

Another preferred embodiment is characterized in that one of the parts of the actuating member comprises a projection which co-operates with a circular groove in the housing wall, which groove adjoins the opening in the wall.

When the actuating member is turned the projection moves inside the groove, the two ends of the groove defining the maximum angle of rotation of the actuating member. An advantage of this embodiment is that the valves are not loaded unnecessarily in their extreme positions.

A further embodiment is characterized in that the actuating member contains a rectangular spring which is provided with a projecting portion which alternately co-operates with at least two recesses formed in the housing wall and adjoining the opening in the wall.

By means of this construction the valves can be latched in specific positions, so that the valve positions cannot change as a result of the air flowing past the valves.

A favourable embodiment is characterized in that the housing comprises two sections which are rotatable relative to each other, one of the housing sections including the air outlet, the valves and the actuating member and the housing sections each being provided with a connecting means and a latching means.

This embodiment allows the user to select the direction of the flow of air. Preferably, the connecting means comprises at least one projecting coupling portion on one of the housing sections and a circular groove which is formed in the other housing section and which co-operates with said coupling portion, and the latching means comprises a plate spring which is secured to one of the housing sections and teeth which are formed in the other housing section and which co-operate with said spring.

Figure 2:
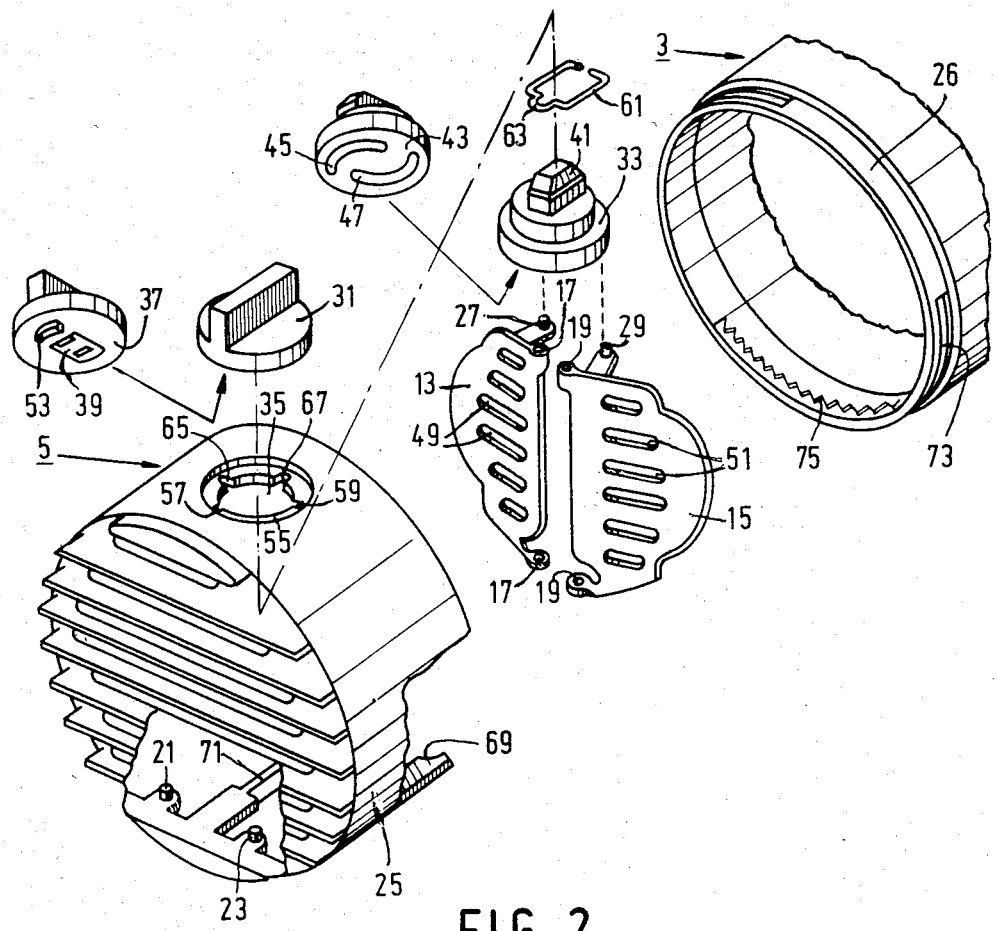

The invention will now be described in more detail with reference to the accompanying drawings, in which:

FIG. 1 is a perspective view of a hair-drier in accordance with the invention, and FIG. 2 is a partly cut-away exploded view on an enlarged scale of a part of the hair-drier shown in FIG. 1.

The hair-drier shown in FIG. 1 comprises a tubular housing 1 formed of a housing section 3 and a housing section 5 rotatable relative to each other. The housing section 3 is provided with an air inlet, a heating element and a fan, which parts are not shown. Moreover, the housing section 3 includes a switch 7 for actuation of the fan and the heating element. The housing section 5 has an air outlet 9 and an actuating member 11, by means of which the air-flow rate can be adjusted.

Two valves or valve members 13 and 15, shown in FIG. 2 can be actuated by means of the actuating member 11 and, in the assembled condition, said valves are arranged opposite each other and are pivotally mounted in the housing section 5. The valves 13 and 15 are respectively formed with a pair of openings 17 and a pair of openings 19 which engage with two spindles 21 and 23 respectively, which spindles are secured to the wall 25 of the housing section 5. In FIG. 2 only two of the four spindles are visible. Moreover, the valves 13 and 15 are provided with projections 27 and 29 respectively.

The actuating member 11 comprises two engaging parts 31 and 33. The first part 31 extends into an opening 35 in the wall 25 and is mainly situated outside the housing section 5. This first part 31 is formed as a knob in whose bottom surface 37 a recess 39 is formed. The second part 33 is situated inside the housing section 5 and is provided with a coupling element 41 which engages the recess 39 in the first part 31. The second part 33 has two curved, preferably circular, grooves or slots 45 and 47 in the side 43 facing the valves. The projection 27 engages in the groove 45 and the projection 29 in the groove 47. When the knob 31 is turned the projections 27 and 29 move in the respective grooves 45 and 47, the valves 13 and 15 being pivoted towards or away from each other, depending on the direction of rotation, about the spindles 21 and 23 respectively. When the valves 13 and 15 are pivoted towards each other the air passage is reduced and the flow rate increases if the speed of the fan remains the same. However, if the valves 13 and 15 are pivoted away from each other the air passage becomes larger so that the flow rate decreases. The valves 13 and 15 are formed with a plurality of apertures 49 and 51 respectively in order to ensure that the air passage cannot be closed completely by the valves.

The first part 31 of the actuating member 11 is provided with a projection 53 which engages a circular groove 55 in the wall 25. When the actuating member 11 is rotated the projection 53 moves in the groove 55, the ends 57 and 59 of the groove 55 defining the maximum angle of rotation of the actuating member 11.

On the coupling element 41 of the second part 33 a rectangular spring 61 is arranged, having a projecting portion 63. The spring 61 is accommodated in the opening 35 in the wall 25, which is provided with two recesses 65 and 67. If the projecting portion is located in one of the recesses 65 and 67, the corresponding position of the valves 13 and 15 cannot be changed by the air flowing past them.

The housing section 5 is rotatable and lockable relative to the housing section 3. For this purpose the housing sections is provided with a plurality of projecting coupling portions 69 and a plate spring 71 and the housing section 3 is provided with a partly circular groove 73 in the wall 26 and teeth 75. The coupling portions 69 engage the circular groove 73 and the plate spring 71 alternately engages the gaps between the teeth 75. By holding the housing section 3 and exerting a tangential force on the housing section 5 in a desired direction of rotation the housing section 5 is rotated relative to the housing section 3. The portions 69 then slide in the groove 73 and the plate spring 71 is moved across the teeth 75. In the desired position the plate spring 71 engages one of the gaps between the teeth 75, so that the housing sections 3 and 5 are latched relative to each other.

What is claimed is:

1. A hair-drier which comprises a tubular housing having an air outlet; two valve members pivotally mounted in the housing for controlling the flow of air therethrough; an opening formed in the wall of the housing; a rotatable member extending through said opening for actuating said valve members; two curved slots formed in said actuating member; and a projection on each valve member for respective engagement with said curved slots whereby, upon turning of the actuating member, said valve members are pivoted in opposite directions.

2. A hair-drier according to claim 1, in which the actuating member comprises a first part and a second part engageable with each other, the first part being disposed mainly outside the housing and the second part being disposed inside the housing, the curved slots being formed in said second part.

3. A hair-drier according to claim 2, in which one of the actuating member parts has a projection engageable with a circular groove formed in the housing wall adjacent the opening in said wall.

4. A hair-drier according to claim 1, in which the actuating member includes a rectangular spring formed with a projecting portion alternately engageable with at least two recesses formed in the housing wall adjacent the opening in said wall.

5. A hair-drier according to claim 1, in which the housing comprises two sections rotatable relative to each other, one housing section including the air outlet, the valve members and the actuating member, and which includes means for connecting and means for latching the two housing sections to each other.

6. A hair-drier according to claim 5, in which the connecting means comprises at least one projecting coupling portion on one housing section and a partly circular groove formed in the other housing section for engagement by said coupling portion, and the latching means comprises a plate spring secured to one housing section and teeth formed in the other housing section for engagement by said plate spring.

* * * * *